US008602240B1

(12) United States Patent
Laurita

(10) Patent No.: US 8,602,240 B1
(45) Date of Patent: Dec. 10, 2013

(54) METHOD AND APPARATUS FOR CARRIER

(71) Applicant: Joseph N. Laurita, Wayne, NJ (US)

(72) Inventor: Joseph N. Laurita, Wayne, NJ (US)

( * ) Notice: Subject to any disclaimer, the term of this patent is extended or adjusted under 35 U.S.C. 154(b) by 0 days.

(21) Appl. No.: 13/758,253

(22) Filed: Feb. 4, 2013

(51) Int. Cl.
*B65D 6/00* (2006.01)

(52) U.S. Cl.
USPC ..... 220/4.28; 220/666; 206/431; 206/747

(58) Field of Classification Search
USPC ..... 220/4.28, 4.34, 4.33, 7, 6, 666, 691; 206/427, 431, 747, 766, 774
See application file for complete search history.

(56) References Cited

U.S. PATENT DOCUMENTS

| | | | | | |
|---|---|---|---|---|---|
| 709,663 | A | * | 9/1902 | Budweiser | 220/817 |
| 752,756 | A | * | 2/1904 | Christie | 190/109 |
| 792,183 | A | * | 6/1905 | Tiderman | 190/114 |
| 1,967,506 | A | * | 7/1934 | Harrison | 220/6 |
| 2,517,178 | A | | 8/1950 | Cheatham | 217/15 |
| 2,841,306 | A | | 7/1958 | Vitoux | 220/7 |
| 3,245,572 | A | * | 4/1966 | Mashy et al. | 312/109 |
| 3,371,816 | A | | 3/1968 | Ricci | 220/4.28 |
| 3,469,762 | A | | 9/1969 | Torre | 229/122 |
| 3,476,303 | A | | 11/1969 | Smith | 229/117.08 |
| 3,497,127 | A | | 2/1970 | Box | 220/7 |
| 3,735,430 | A | | 5/1973 | Platz | 5/118 |
| 3,889,837 | A | | 6/1975 | Wilson | 220/7 |
| 3,938,819 | A | | 2/1976 | Martin | 280/19 |
| 4,057,165 | A | | 11/1977 | Kardell | 220/6 |
| 4,171,058 | A | | 10/1979 | Collins | 217/12 R |
| 4,181,356 | A | | 1/1980 | Fleischer | 297/350 |
| 4,256,236 | A | | 3/1981 | Haase | 220/6 |
| 4,609,116 | A | | 9/1986 | Simms | 217/12 R |
| 4,757,897 | A | * | 7/1988 | Fogt | 206/427 |
| 4,781,300 | A | | 11/1988 | Long | 220/7 |
| 4,955,925 | A | | 9/1990 | Platti | 15/257.6 |
| 5,211,434 | A | | 5/1993 | Lanava | 220/7 |
| 5,588,549 | A | | 12/1996 | Furtner | 220/7 |
| 5,597,084 | A | | 1/1997 | Parasin | 220/4.28 |
| 5,743,389 | A | | 4/1998 | Cutler | 206/216 |
| 5,967,356 | A | * | 10/1999 | Laarhoven et al. | 220/6 |
| 6,142,365 | A | * | 11/2000 | Breitbach | 229/198.2 |
| 6,233,766 | B1 | | 5/2001 | Ohman | 5/627 |
| 6,640,944 | B2 | | 11/2003 | Adams | 190/110 |
| 7,350,661 | B2 | * | 4/2008 | Endou | 220/6 |
| 7,909,000 | B1 | | 3/2011 | O'Neill | 119/61.1 |
| 2005/0173269 | A1 | | 8/2005 | Lebras | 206/170 |
| 2005/0189388 | A1 | | 9/2005 | Godshaw | 224/607 |
| 2006/0027578 | A1 | * | 2/2006 | Cadiente et al. | 220/23.88 |
| 2006/0201849 | A1 | | 9/2006 | Huang | 206/736 |
| 2008/0142530 | A1 | * | 6/2008 | Meers et al. | 220/666 |
| 2010/0230479 | A1 | | 9/2010 | Graham | 229/108.1 |
| 2012/0061277 | A1 | | 3/2012 | Lohse | 206/504 |

* cited by examiner

*Primary Examiner* — J. Gregory Pickett
*Assistant Examiner* — James Way
(74) *Attorney, Agent, or Firm* — Walter J. Tencza, Jr.

(57) ABSTRACT

An apparatus and a method for carrying beverage containers, such as milk cartons. The apparatus may include a first wall, a second wall, a base, a first device, and a second device. The first and the second walls may be fixed to the base so that the first and the second walls are substantially perpendicular to the base, and the first and the second walls are parallel to each other and separated by a first distance. The first and second devices may be connected to the base so that the first and second devices can rotate with respect to the base. The first and the second devices may be connected to the base so that the first and the second devices can be rotated into a states in which a wall of each is substantially parallel or substantially perpendicular to the base.

23 Claims, 9 Drawing Sheets

METHOD AND APPARATUS FOR CARRIER

FIELD OF THE INVENTION

This invention relates to improved methods and apparatus concerning carriers for beverage containers, such as milk cartons.

BACKGROUND OF THE INVENTION

U.S. Pat. No. 2,517,178 to Cheatham discloses a folding container in which the end walls 12 and side walls 13 are hingedly secured to a bottom 11, so that the side walls 13 may be folded inwardly over the end walls 12. (Cheatham, col. 1, Ins. 5-10; col. 2, Ins. 17-32; FIG. 1 ). Bolts 23 are engaged with keepers 21 to prevent the walls when interlocked from folding outwardly or inwardly. (Cheatham, col. 3, Ins. 1-10; FIG. 1). Hinges 14 and 18, and bolts 23 and keepers 21 provide a cumbersome device in Cheatham. The end walls 12 and side walls 13 nearly completely enclose a large chamber area which requires a large amount of material for walls 12 and 13. (Cheatham, FIG. 1). The hinges 18 and the hinges 14 are separate from the walls 13 and 12 and protrude outward and inwards, respectively, from the walls 13 and 12. (Cheatham, FIG. 1).

U.S. Pat. No. 3,371,816 to Ricci discloses assembling two side walls 11, two end walls 12, and a base 10 together to form a receptacle. (Ricci, col. 3, Ins. 1-10; FIGS. 4 and 5). A protrusion at the bottom of an insert 26, is inserted into U-shaped channel 13 of base 10 to connect side walls 11 to base 10. (Id.) An inside sheet 30 of each of end walls 12 is slid until the inside sheet 30 comes to rest within the U-shaped channel 13 of the base 10. (Id.)

SUMMARY OF THE INVENTION

In at least one embodiment, an apparatus is provided which may be used for carrying beverage containers, such as milk cartons. The apparatus may include a first wall, a second wall, a base, a first device, and a second device.

The first and the second walls are fixed to the base so that the first and the second walls are substantially perpendicular to the base, and the first and the second walls are parallel to each other and separated by a first distance. The first and second devices may be connected to the base so that the first and second devices can rotate with respect to the base.

The first device may include a third wall, a fourth wall, and a fifth wall, wherein the third wall is fixed substantially perpendicular to the fourth and the fifth walls, and the fourth and the fifth walls are fixed to the third wall so that the fourth and the fifth walls are substantially parallel to each other and spaced apart by the third wall.

The second device may include a sixth wall, a seventh wall, and an eighth wall, wherein the sixth wall is fixed substantially perpendicular to the seventh and the eighth walls, and the seventh and the eighth walls are fixed to the sixth wall, so that the seventh and eight walls are substantially parallel to each other and spaced apart by the sixth wall.

The first device may be connected to the base so that the first device can be rotated into a first state in which the third wall is substantially parallel to the base. The second device may be connected to the base so that the second device can be rotated into a second state in which the sixth wall is substantially parallel to the base. The first device may be connected to the base so that the first device can be rotated into a third state in which the third wall is substantially perpendicular to the base. The second device may be connected to the base so that the second device can be rotated into a fourth state in which the sixth wall is substantially perpendicular to the base.

The third wall of the first device may have a width, and each of the fourth and the fifth walls may have a width which is substantially perpendicular to the width of the third wall, and wherein the fourth and the fifth walls protrude out from the third wall in the direction of the width of the fourth and the fifth walls, respectively.

The sixth wall of the second device may have a width, and each of the seventh and the eighth walls have a width which is substantially perpendicular to the width of the sixth wall, and wherein the seventh and the eighth walls protrude out from the sixth wall in the direction of the width of the seventh and the eighth walls, respectively.

In at least one embodiment, in the third state in which the third wall is substantially perpendicular to the base, the fourth wall of the first device contacts a top edge of the first wall, wherein the top edge of the first wall is substantially parallel to the base, and the fifth wall of the first device simultaneously contacts a top edge of the second wall, wherein the top edge of the second wall is substantially parallel to the base.

In at least one embodiment, in the fourth state in which the sixth wall is substantially perpendicular to the base, the seventh wall of the second device contacts the top edge of the first wall, and the eighth wall of the second device simultaneously contacts the top edge of the second wall.

In at least one embodiment, the width of each of the fourth and the fifth walls is substantially less than the width of the third wall, and the width of each of the seventh and the eighth walls is substantially less than the width of the sixth wall.

In at least one embodiment, the first wall has a height which is a perpendicular distance from the base to the top edge of the first wall, and the second wall has a height which is a perpendicular distance from the base to the top edge of the second wall. The heights of the first wall and the second wall may be about the same and may be about equal to the width of the fourth, fifth, seventh, and eighth walls.

The first wall may have a first indentation and a second indentation, and the second wall may have a first indentation and a second indentation. The fourth, fifth, seventh, and eighth walls may each have a protrusion, wherein the protrusions of the fourth and fifth walls fit into the first indentation of the first wall, and the first indentation of the second wall, respectively, when the first device is in the third state; and wherein the protrusions of the seventh and eighth walls fit into the second indentation of the first wall, and the second indentation of the second wall, respectively, when the second device is in the fourth state.

The apparatus may further include a first member fixed perpendicular to the first wall at a first end of the first wall, the first member having a bore, a second member fixed perpendicular to the second wall at a first end of the second wall, the second member having a bore, a third member fixed perpendicular to the first wall at a second end of the first wall opposite the first end of the first wall, the third member having a bore, and a fourth member fixed perpendicular to the second wall at a second end of the first wall opposite the first end of the first wall, the second member having a bore, a fifth member fixed to the first device having a bore, and a sixth member fixed to the second device having a bore. The apparatus may further include a first axle inserted into the bores of the first member, the second member, and the fifth member to rotatably connect the first device to the base, and a second axle inserted into the bores of the third member, the fourth member, and the sixth member to rotatably connect the second device to the base.

The first device may include a first U-shaped ridge, which protrudes out from a combination of the third wall, the fourth wall, and the fifth wall. The second device may include a second U-shaped ridge which protrudes out from a combination of the sixth wall, the seventh wall, and the eighth wall. The first device may include a third U-shaped ridge, spaced apart from and parallel to the first U-shaped ridge, which protrudes out from a combination of the third wall, the fourth wall, and the fifth wall. The second device may include a fourth U-shaped ridge, spaced apart from and parallel to the second U-shaped ridge, which protrudes out from a combination of the sixth wall, the seventh wall, and the eighth wall. The first device may include a fifth U-shaped ridge, spaced apart from and parallel to the first and the third U-shaped ridges, which protrudes out from a combination of the third wall, the fourth wall, and the fifth wall. The second device may include a sixth U-shaped ridge, spaced apart from and parallel to the second and the fourth U-shaped ridges, which protrudes out from a combination of the sixth wall, the seventh wall, and the eighth wall.

In at least one embodiment, when the first device is in the third state and the second device is simultaneously in the fourth state, there is a first gap between the first device and the second device adjacent the first wall and a second gap between the first device and the second device adjacent the second wall. In at least one embodiment, when the first device is in the third state and the second device is simultaneously in the fourth state the apparatus has a height and a length. The first gap may have a height which is about equal to or greater than one half of the height of the apparatus and a length which is about equal to or greater than one half of the length of the apparatus. The second gap may have a height which is about equal to or greater than one half of the height of the apparatus and a length which is about equal to or greater than one half of the length of the apparatus.

The base may have a first plurality of openings, the third wall may have a second plurality of openings, and the sixth wall may have a third plurality of openings.

In at least one embodiment, a method is provided which may include inserting a plurality of beverage containers into a chamber of an apparatus, the chamber formed by a first wall, a second wall, a base, a first device, and a second device. The apparatus may be configured as previously described.

DETAILED DESCRIPTION OF THE DRAWINGS

Figure 1A:
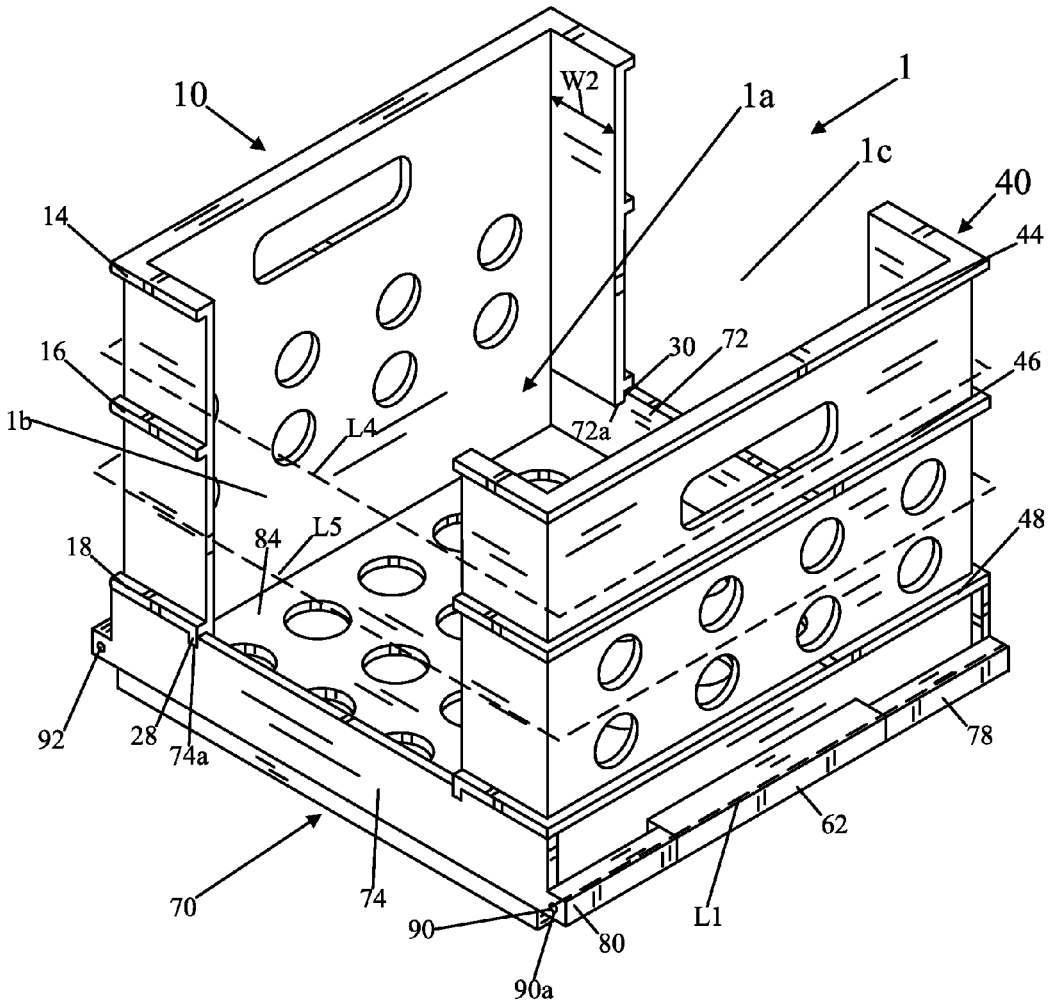
FIG. 1A shows a front, right, top perspective view of an apparatus in accordance with an embodiment of the present invention, with the apparatus of FIG. 1A shown in an upright state.
Figure 1B:
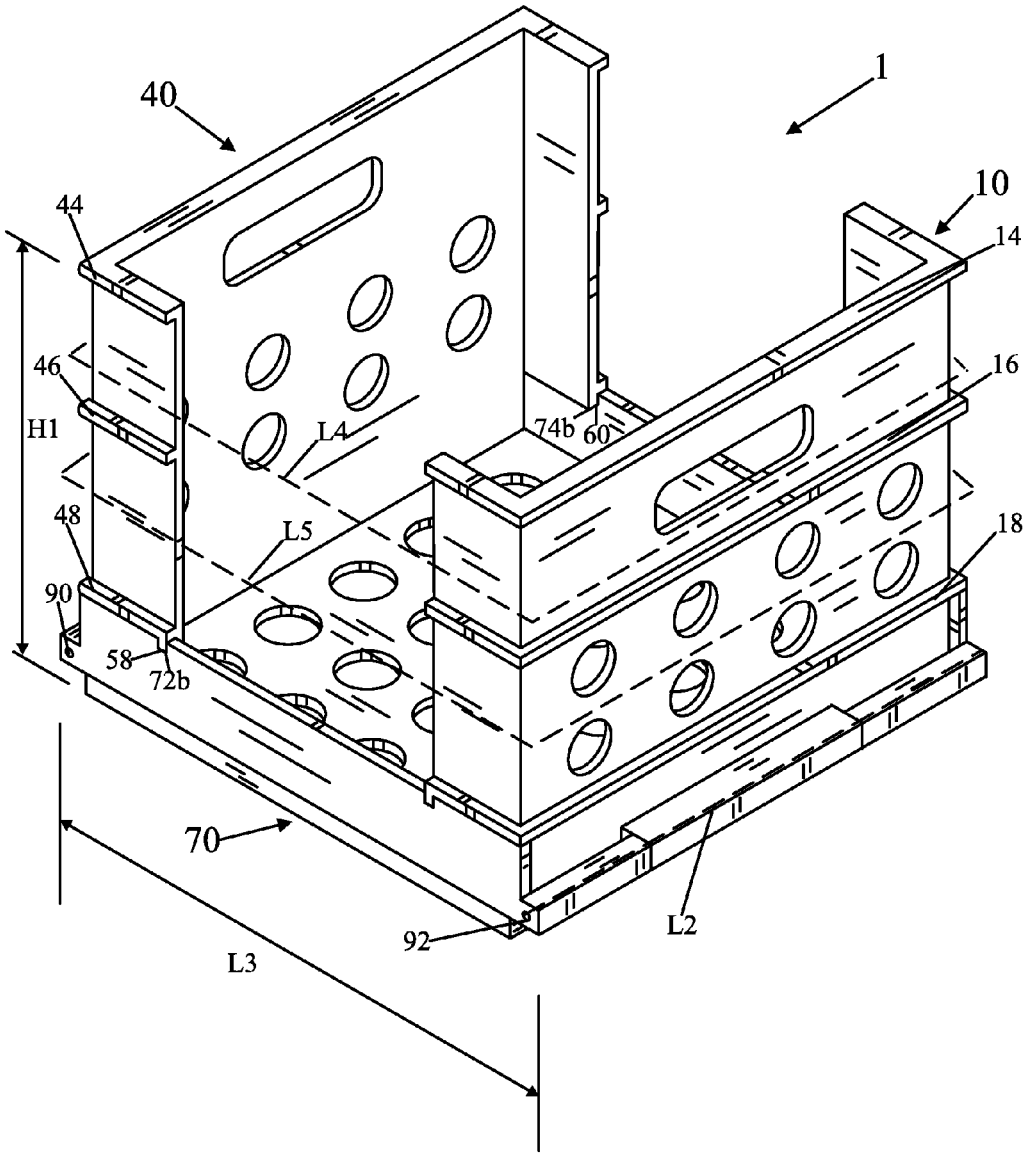
FIG. 1B shows a rear, left, top perspective view of the apparatus of FIG. 1A, with the apparatus of FIG. 1A shown in an upright state.
Figure 4A:
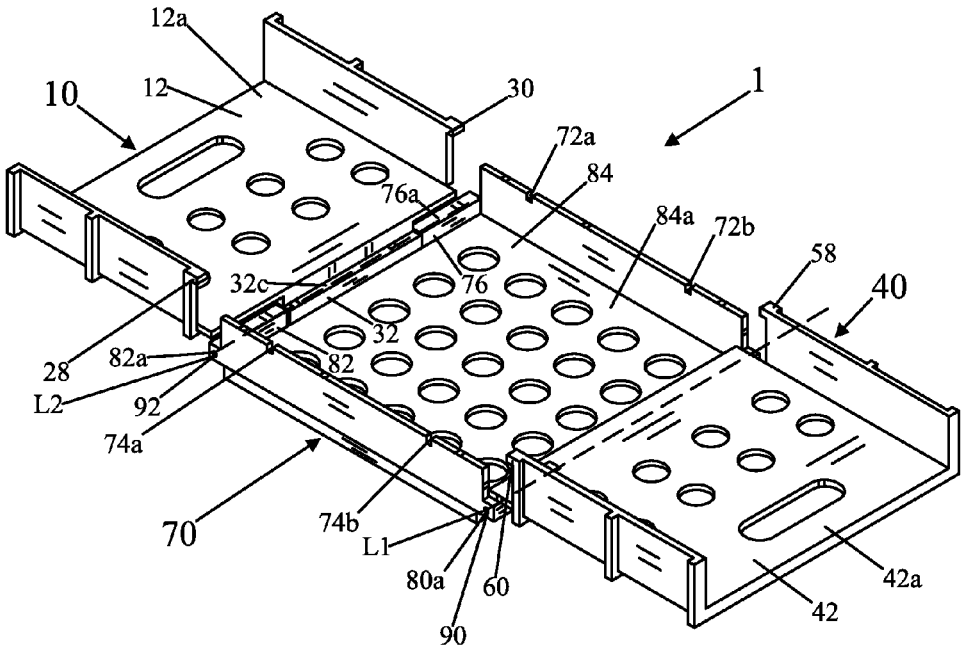
FIG. 4A shows a front, right, top perspective view of the apparatus of FIG. 1A in a flattened state.
Figure 4B:
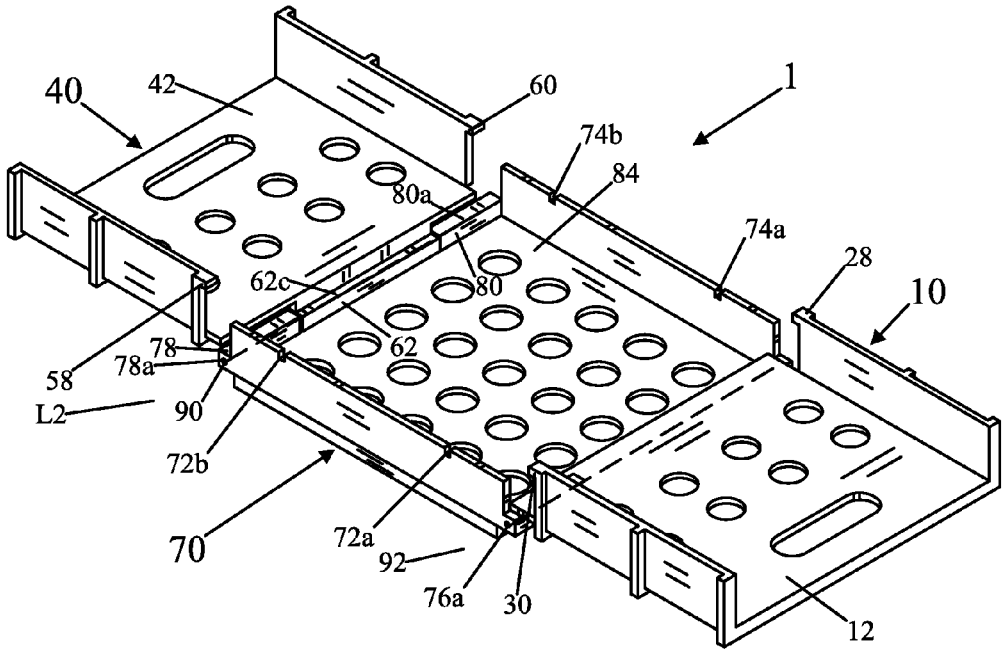
FIG. 4B shows a rear, left, top perspective view of the apparatus of FIG. 1A in the flattened state.

FIG. 1A shows a front, right, top perspective view of an apparatus 1 in accordance with an embodiment of the present invention, with the apparatus 1 shown in an upright state. FIG. 1B shows a rear, left, top perspective view of the apparatus 1, with the apparatus 1 shown in an upright state. The apparatus 1 includes a left section 10, a right section 40, and a base 70. The left section 10 is attached to the base 70 by a pin or axle 92, which allows the left section 10 to rotate with respect to the base 70, from an upright position as shown in FIGS. 1A-B to a flattened position as shown in FIGS. 4A-4B. Similarly, the right section 40 is attached to the base 70 by a pin or axle 90, which allows the right section 40 to rotate with respect to the base 70, from an upright position as shown in FIGS. 1A-B to a flattened position as shown in FIGS. 4A-4B.

As shown in FIG. 1A, the left section or device 10, walls 72 and 74, the right section or device 40, and a bottom 84 of base 70 form a chamber 1*a*. The chamber 1*a* is not fully closed and there is a gap 1*b* between devices 10 and 40, adjacent the wall 74 and a gap 1*c* between devices 10 and 40, adjacent the wall 72. In at least one embodiment each of the gaps 1*b* and 1*c* has a length which is typically at least about half or more than half the length L3 of the apparatus 1 shown in FIG. 1B, and a height, which is at least about half or more than half of the height H1 of the apparatus 1. Having these gaps 1*b* and 1*c* saves money because less material is needed for making of the apparatus 1. In at least one embodiment, cellophane or other strong lightweight wrapping material is wrapped around the periphery of apparatus 1, such as between ridges 14 and 16, and between ridges 44 and 46 as shown by dashed lines L4, and between ridges 16 and 18 and 46 and 48 as shown by dashed lines L5 shown in FIGS. 1A and 1B. Beverage containers, such as milk cartons, may be placed upright in the chamber 1*a*, so that they sit on upright on the floor 84 of the base 70. The dimensions of the chamber 1*a* and the apparatus 1, may be designed to snugly, precisely fit a predetermined number of beverage containers of the same type, such as predetermined number of milk cartons. Typically, the chamber 1*a* is configured so that the beverage containers will not exceed the height of the device 10 and the device 40, so that an apparatus 1 containing beverage containers, may be stacked on an identical apparatus 1, containing beverage containers, without the bottom of member 88 shown in FIG. 2A, contacting the beverage containers in the apparatus below.

Figure 2A:
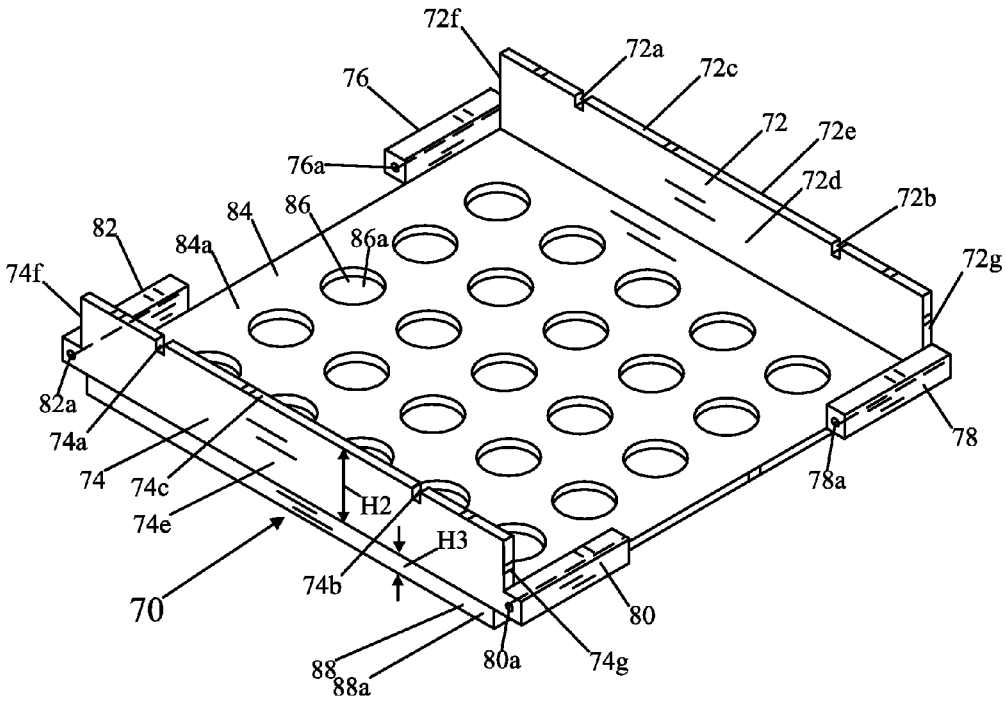
FIG. 2A shows a front, right, top perspective view of a base of the apparatus of FIG. 1A.
Figure 2B:
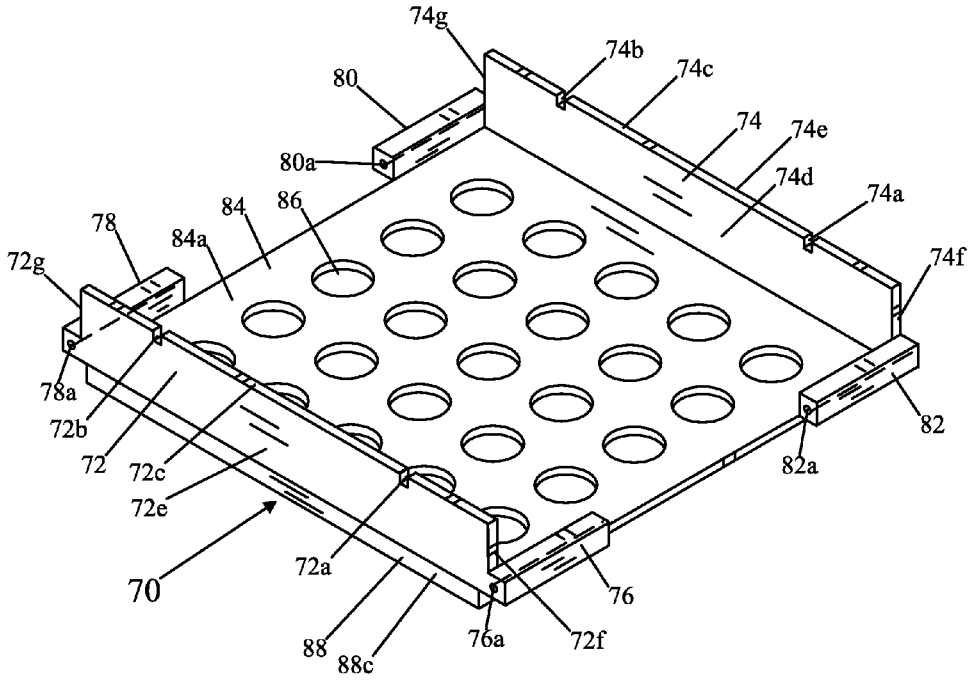
FIG. 2B shows a rear, left, top perspective view of the base of FIG. 2A.

FIG. 2A shows a front, right, top perspective view of the base 70 of the apparatus 1. FIG. 2B shows a rear, left, top perspective view of the base 70. The base 70 includes plates 72 and 74, members 76, 78, 80, and 82, and floor 84. The plate 72 slots 72*a* and 72*b*, top edge 72*c*, inside surface 72*d*, outside surface 72*e*, and outside edges 72*f* and 72*g*. Similarly or identically, the plate 74 has slots 74*a* and 74*b*, top edge 74*c*, inside surface 74*d*, outside surface 74*e*, and outside edges 74*f* and 74*g*. The members 76, 78, 80, and 82 may be substantially shaped in the form of rectangular prisms, with central or substantially cylindrical bores 76*a*, 78*a*, 80*a*, and 82*a*, respectively, running through the rectangular prism shapes, as shown by dashed lines.

The floor 84 may have a plurality of circular openings 86 through it, including opening 86*a*. The openings 86 may be used to reduce the weight of the apparatus 1. Each of openings 86 may be circular and may have a diameter of one and three-eighths inches. In at least one embodiment, the plate 72 is parallel or substantially parallel to the plate 74, and both plates 72 and 74 are fixed to the floor 86, substantially perpendicular or perpendicular to the floor 86. The members 76, 78, 80, and 82, in at least one embodiment are fixed to the floor 86. The members 82 and 80 are typically fixed to the plate 74, so that bores 82*a* and 80*a* are substantially perpendicular to the plate 74. The members 76 and 78 are typically fixed to the plate 72, so that bores 76*a* and 78*a* are substantially perpendicular to the plate 72. The members 76, 78, 80, and 82 are fixed, in at least one embodiment, so that bores 82*a* and 76*a* are aligned for receiving pin 90, and bores 80*a* and 78*a* are aligned for receiving pin 92.

Attached and/or fixed to the bottom of the floor 84 is a peripheral wall 88 shown in FIGS. 2A-2B. The wall 88 includes portion 88*a* shown in FIG. 2A and portion 88*c* shown in FIG. 2B. Each of the plates 72 and 74 may have a height H2, which may be two inches, perpendicular to the floor 84. The peripheral wall 88 fixed to the bottom of the floor 84 may have a height H3, which may be one half of an inch, perpendicular to the floor 84.

Figure 3A:
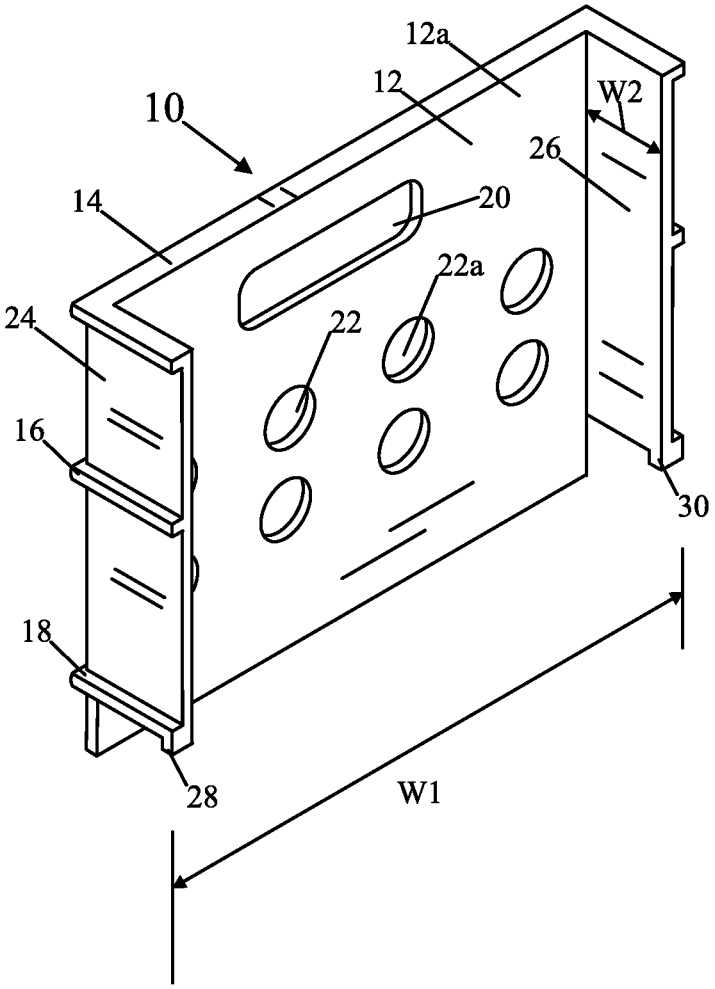
FIG. 3A shows a front, right, top perspective view of a left section of the apparatus of FIG. 1A.

Each of sections or plates 24 and 26 may have a width W2, shown in FIGS. 1A and 3A, which may be about two inches, perpendicular to the width W1, shown in FIG. 3A, of the plate or section 12. Each of ridges 14, 16, and 18 may protrude out about one eighth of an inch from the plate 12 and from the plates or sections 24 and 26. Each of openings 22 may be circular and have a diameter of about one and three eighths inches. The slot opening 20 may have a width, parallel to the width W1, which may be about four and half inches. The slot opening 20 is elongated to form a handle, with the length of the slot perpendicular to the width, about one and one quarter inches. The protrusions 28 and 30, shown in FIG. 3A, may protrude downwards about one eighth of an inch from the ridge 18. The protrusions 28 and 30 are configured to fit snugly within slots 74*a* and 72*a*, to stop the left section 10 from moving further after being rotated to the upright position, shown in FIGS. 1A-1B. The slots 74*a* and 72*a* may be slightly larger than the protrusions 28 and 30. Protrusions on right section 40, similar or identical to protrusions 28 and 30 are configured to fit snugly within slots 74*b* and 72*b*, to stop the right section 40 from moving further after being rotated to the upright position, shown in FIGS. 1A-1B.

The base 70 may be made of hard plastic and may be molded as a one piece unit.

Figure 2C:
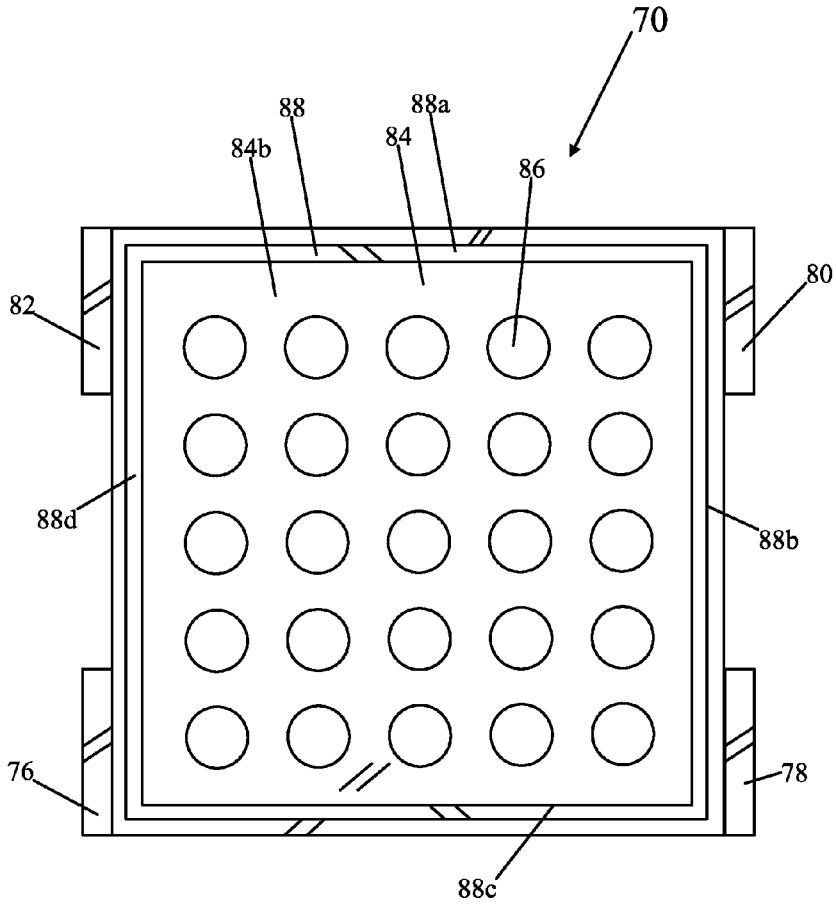
FIG. 2C shows a bottom view of the base of FIG. 2A.

FIG. 2C shows a bottom view of the base 70. FIG. 2C shows the bottom edge of the peripheral wall 88. The peripheral wall 88 extends from a bottom surface 84*b* of the floor or bottom 84 as shown by FIGS. 2A and 2B. The wall 88 includes portions 88*a*, 88*b*, 88*c*, and 88*d*.

Figure 3B:
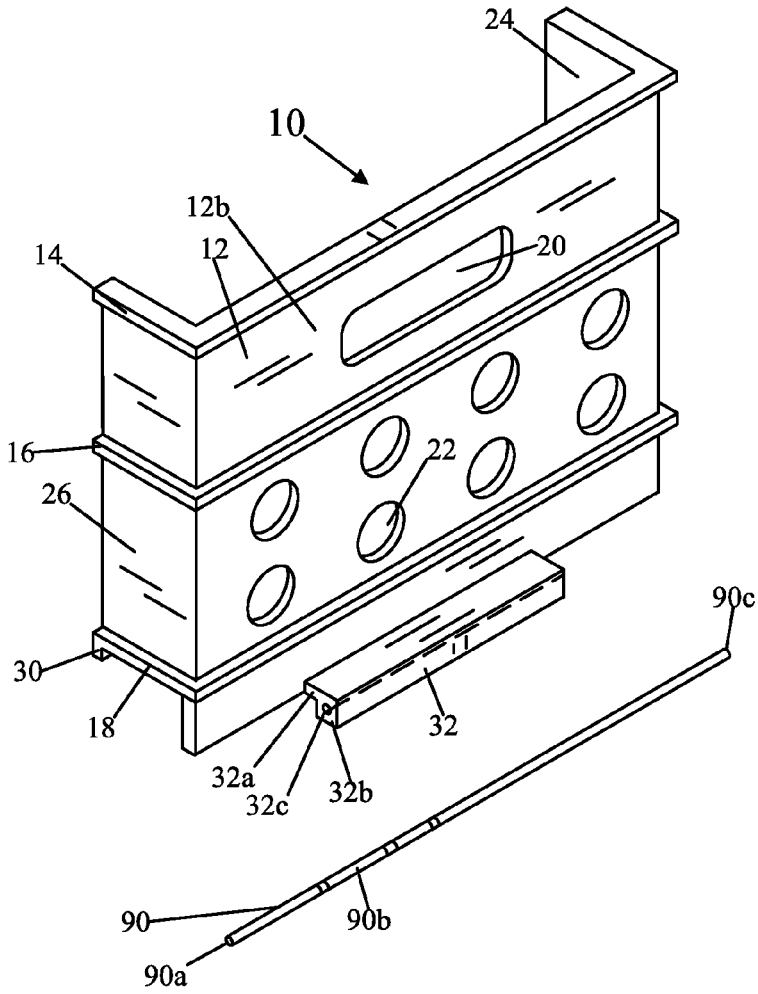
FIG. 3B shows a rear, left, top perspective view of the left section of FIG. 3A, and a perspective view of a pin for attaching a section of the apparatus of FIG. 1A to the base of FIG. 2A.

FIG. 3A shows a front, right, top perspective view of a left section 10 of the apparatus 1. FIG. 3B shows a rear, left, top perspective view of the left section 10. The left section 10 may include a plate or section 12, a plate or section 24, and a plate or section 26. The plates 24 and 26 are fixed to the plate 12, perpendicular to the plate 12, and so that the plates 24 and 26 are parallel to each other.

The plate 12 has a plurality of openings 22, which may be circular including opening 22*a*. The plate 22 also has an elongated slot opening 20 which may be used as a handle. The plate 12 includes an inner surface 12*a* shown in FIG. 3A and an outer surface 12*b* shown in FIG. 3B. Peripheral flanges, ridges, or protrusions 14, 16, and 18 protrude outward from the outer surface 12*b* of the plate 12, and from the plates 24 and 26. The peripheral flanges 14, 16, and 18 are parallel to the width W1 of the left section 10 shown in FIG. 3A. Each flange includes a central section which protrudes out from and is parallel to the outer surface 12*b* shown in FIG. 3B, a first outer section which protrudes out from the plate 24 and is perpendicular to or substantially perpendicular to the outer surface 12*b*, and a second outer section which protrudes out from the plate 26 and is perpendicular to or substantially perpendicular to the outer surface 12*b*.

The left section 10 also includes downward protrusions or devices 28 and 30 which are perpendicular or substantially perpendicular to the flanges 14, 16, and 18.

The right section 40 is identical or substantially identical to the left section 10.

A pin or axle 90 is also shown in FIG. 3B. The pin 90 may include an end 90*a* a body portion 90*b*, and an end 90*c*. The pin 90 may be cylindrical or substantially cylindrical. The pin 92 referred to in FIGS. 1A and 1B, may be identical or substantially the same as the pin 90.

FIG. 4A shows a front, right, top perspective view of the apparatus 1 in a flattened state. FIG. 4B shows a rear, left, top perspective view of the apparatus 1 in the flattened state. In FIGS. 4A and 4B, the inner surface 12*a* of the plate 12 of the left section 10, and the inner surface 42*a* of the plate 42 of the right section 40 are parallel or substantially parallel to the surface 84*a* of the plate 84 of the base 70. In FIGS. 1A-1B and FIGS. 4A-4B, the pin 92 is in the bores 82*a*, 32*c*, and 76*a* through line L2, to thereby rotatably connect the left section 10 with the base 70. Similarly, or identically, the pin 90 is in the bore 80*a*, the bore for right section 40 analogous to bore 32*c*, but not shown, and the bore 78*a* through line L2, to thereby rotatably connect the left section 10 with the base 70.

More precisely, a left or first outer part of pin 92 sits in bore 82*a*, while simultaneously a central part of pin 92 sits in bore 32*c*, and while simultaneously a right or second outer part of pin 92 sits in bore 76*a*, in order to rotabably connect the left section 10 with the base 70. Similarly, or identically a left or first outer part of pin 90 sits in bore 80*a*, while simultaneously a central part of pin 90 sits in bore a bore for section 40, analogous to bore 32*c*, and while simultaneously a right or second outer part of pin 90 sits in bore 78*a*, in order to rotabably connect the right section 40 with the base 70.

The apparatus or carrier 1 may have an overall length of L3, shown in FIG. 1B which may be about twelve inches in at least one embodiment. The apparatus 1 may have an overall height H1, shown in FIG. 1, which may be about twelve inches. The apparatus 1 may have an overall width W1, shown in FIG. 3A, which may be about twelve and three quarters inches.

The left section 10 can be attached to the base 70 by inserting the section or portion 32, shown in between the members 76 and 82 as shown in FIG. 4A. With the section 10 configured with respect to the base 70 as shown in FIG. 4A, the pin 92 can be inserted into the bores 82*a*, 32*c*, and 76*a*, so that a left side of the pin 92 lies in bore 82*a*, while a central portion of the pin 92 lies in bore 32*c*, and while a right side of the pin lies in bore 76*a*. The pin 92 may snugly fit in the bores 82*a*, 32*c*, and 76*a*, so that the pin 92 is held in the bores 82*a*, 32*c*, and 76*a* and does not easily fall out. With the section 10 and the base 70 configured and attached as shown in FIG. 4A, the left section 10 can rotate with respect to the base 70 from a flattened state as in FIG. 4A, to an upright state as in FIG. 1A. In the upright state of FIG. 1A, the protrusion 28 fits into the slot or indentation 74*a* while the protrusion 30 simultaneously fits into the slot or indentation 72*a*. The protrusions 28 and 30 thus prevent the left section 10 from rotating inward towards the base 70 beyond the upright, perpendicular orientation with respect to the floor 84 of the base 70.

Similarly or identically, the right section 40 can be attached to the base 70 by inserting the section or portion 62, shown in between the members 78 and 80 as shown in FIG. 4B. With the section 40 configured with respect to the base 70 as shown in FIG. 4B, the pin 90 can be inserted into the bores 78*a*, 62*c*, and 80*a*, so that a left side of the pin 90 lies in bore 78*a*, while a central portion of the pin 90 lies in bore 62*c*, and while a right side of the pin lies in bore 78*a*. The pin 90 may snugly fit in the bores 78*a*, 62*c*, and 80*a*, so that the pin 90 is held in the bores 78*a*, 62*c*, and 80*a* and does not easily fall out. With the section 40 and the base 70 configured and attached as shown in FIG. 4B, the right section 40 can rotate with respect to the base 70 from a flattened state as in FIG. 4B, to an upright state as in FIG. 1B. In the upright state of FIG. 1B, the protrusion 58 fits into the slot or indentation 72*b* while the protrusion 60 simultaneously fits into the slot or indentation 74*b*. The protrusions 58 and 60 thus prevent the right section 40 from rotating inward towards the base 70 beyond the upright, perpendicular orientation with respect to the floor 84 of the base 70.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a first wall;

a second wall;

a base, wherein the first and the second walls are fixed to the base so that the first and the second walls are fixed substantially perpendicular to the base, such that the first and the second walls cannot rotate with respect to the base without breaking the apparatus, and the first and the second walls are fixed parallel to each other and separated by a first distance;

a first device connected to the base so that the first device can rotate with respect to the base;

a second device connected to the base so that the second device can rotate with respect to the base;

wherein the first device includes a third wall, a fourth wall, and a fifth wall, wherein the third wall is fixed substantially perpendicular to the fourth and the fifth walls, and the fourth and the fifth walls are fixed to the third wall so that the fourth and the fifth walls are substantially parallel to each other and spaced apart by the third wall;

wherein the second device includes a sixth wall, a seventh wall, and an eighth wall, wherein the sixth wall is fixed substantially perpendicular to the seventh and the eighth walls, and the seventh and the eighth walls are fixed to the sixth wall, so that the seventh and eight walls are substantially parallel to each other and spaced apart by the sixth wall;

wherein the first device is connected to the base so that the first device can be rotated into a first state in which the third wall is substantially parallel to the base;

wherein the second device is connected to the base so that the second device can be rotated into a second state in which the sixth wall is substantially parallel to the base;

wherein the first device is connected to the base so that the first device can be rotated into a third state in which the third wall is substantially perpendicular to the base;

wherein the second device is connected to the base so that the second device can be rotated into a fourth state in which the sixth wall is substantially perpendicular to the base;

wherein the third wall of the first device has a width, and each of the fourth and the fifth walls have a width which is substantially perpendicular to the width of the third wall, and wherein the fourth and the fifth walls protrude out from the third wall in the direction of the width of the fourth and the fifth walls, respectively;

wherein the sixth wall of the second device has a width, and each of the seventh and the eighth walls have a width which is substantially perpendicular to the width of the sixth wall, and wherein the seventh and the eighth walls protrude out from the sixth wall in the direction of the width of the seventh and the eighth walls, respectively;

wherein in the third state in which the third wall is substantially perpendicular to the base, the fourth wall of the first device directly contacts a top edge of the first wall to thereby prevent rotation of the fourth wall inwards towards the base, wherein the top edge of the first wall is substantially parallel to the base, and the fifth wall of the first device simultaneously directly contacts a top edge of the second wall to thereby prevent rotation of the fifth wall inwards towards the base, wherein the top edge of the second wall is substantially parallel to the base;

wherein the prevention of the rotation of the fourth wall inwards towards the base together with the prevention of the rotation of the fifth wall inwards towards the base prevents rotation of the third wall inwards towards the base;

wherein in the fourth state in which the sixth wall is substantially perpendicular to the base, the seventh wall of the second device directly contacts the top edge of the first wall to thereby prevent rotation of the seventh wall towards the base, and the eighth wall of the second device simultaneously directly contacts the top edge of the second wall to thereby prevent rotation of the eighth wall towards the base; and wherein the prevention of the rotation of the seventh wall inwards towards the base together with the prevention of the rotation of the eighth wall inwards towards the base prevents rotation of the sixth wall inwards towards the base.

2. The apparatus of claim 1 wherein the width of each of the fourth and the fifth walls is substantially less than the width of the third wall;

and wherein the width of each of the seventh and the eighth walls is substantially less than the width of the sixth wall.

3. The apparatus of claim 2 wherein the first wall has a height which is a perpendicular distance from the base to the top edge of the first wall;

the second wall has a height which is a perpendicular distance from the base to the top edge of the second wall;

and wherein the heights of the first wall and the second wall are about the same and are about equal to the width of the fourth, fifth, seventh, and eighth walls.

4. The apparatus of claim 1 wherein the first wall was a first indentation and a second indentation;

the second wall has a first indentation and a second indentation;

the fourth wall has a protrusion;

the fifth wall has a protrusion;

the seventh wall has a protrusion;

the eighth wall has a protrusion;

and wherein the protrusions of the fourth and fifth walls fit into the first indentation of the first wall, and the first indentation of the second wall, respectively, when the first device is in the third state; and and wherein the protrusions of the seventh and eighth walls fit into the second indentation of the first wall, and the second indentation of the second wall, respectively, when the second device is in the fourth state.

5. The apparatus of claim 1 further comprising a first member fixed perpendicular to the first wall at a first end of the first wall, the first member having a bore;

a second member fixed perpendicular to the second wall at a first end of the second wall, the second member having a bore;

a third member fixed perpendicular to the first wall at a second end of the first wall opposite the first end of the first wall, the third member having a bore;

a fourth member fixed perpendicular to the second wall at a second end of the first wall opposite the first end of the first wall, the second member having a bore;

a fifth member fixed to the first device having a bore;

a sixth member fixed to the second device having a bore;

a first axle inserted into the bores of the first member, the second member, and the fifth member to rotatably connect the first device to the base; and a second axle inserted into the bores of the third member, the fourth member, and the sixth member to rotatably connect the second device to the base.

6. The apparatus of claim 1 wherein the first device includes a first U-shaped ridge, which protrudes out from a combination of the third wall, the fourth wall, and the fifth wall; and the second device includes a second U-shaped ridge which protrudes out from a combination of the sixth wall, the seventh wall, and the eighth wall.

7. The apparatus of claim 6 wherein the first device includes a third U-shaped ridge, spaced apart from and parallel to the first U-shaped ridge, which protrudes out from a combination of the third wall, the fourth wall, and the fifth wall; and the second device includes a fourth U-shaped ridge, spaced apart from and parallel to the second U-shaped ridge, which protrudes out from a combination of the sixth wall, the seventh wall, and the eighth wall.

8. The apparatus of claim 7 wherein the first device includes a fifth U-shaped ridge, spaced apart from and parallel to the first and the third U-shaped ridges, which protrudes out from a combination of the third wall, the fourth wall, and the fifth wall; and the second device includes a sixth U-shaped ridge, spaced apart from and parallel to the second and the fourth U-shaped ridges, which protrudes out from a combination of the sixth wall, the seventh wall, and the eighth wall.

9. The apparatus of claim 1 wherein when the first device is in the third state and the second device is simultaneously in the fourth state, there is a first gap between the first device and the second device adjacent the first wall and a second gap between the first device and the second device adjacent the second wall;

wherein when the first device is in the third state and the second device is simultaneously in the fourth state the apparatus has a height and a length;

wherein the first gap has a height which is about equal to or greater than one half of the height of the apparatus and a length which is about equal to or greater than one half of the length of the apparatus; and wherein the second gap has a height which is about or equal to or greater than one half of the height of the apparatus and a length which is about equal to or greater than one half of the length of the apparatus.

10. The apparatus of claim 1 wherein the base has a first plurality of openings;

the third wall has a second plurality of openings;

and the sixth wall has a third plurality of openings.

11. The apparatus of claim 1 wherein when the first device is in the third state and the second device is simultaneously in the fourth state the apparatus is configured as a box structure having an open top opposite the base; and wherein when the first device is in the third state and the second device is simultaneously in the fourth state, the fourth wall directly contacts the first wall nearer to the base than to the open top of the box structure, the fifth wall directly contacts the second wall nearer to the base than to the open top of the box structure; the seventh wall directly contacts the first wall nearer to the base than to the open top of the box structure, and the eighth wall directly contacts the second wall nearer to the base than to the open top of the box structure.

12. The apparatus of claim 1 wherein wherein when the first device is in the third state the fourth wall directly contacts the top edge of the first wall to thereby prevent rotation of the fourth wall inwards towards the base, by a ridge of the fourth wall directly contacting the top edge of the first wall;

wherein when the first device is in the third state the fifth wall directly contacts the top edge of the second wall to thereby prevent rotation of the fifth wall inwards towards the base, by a ridge of the fifth wall directly contacting the top edge of the second wall;

wherein when the second device is in the fourth state the seventh wall directly contacts the top edge of the first wall to thereby prevent rotation of the seventh wall inwards towards the base, by a ridge of the seventh wall directly contacting the top edge of the first wall; and wherein when the second device is in the fourth state the eighth wall directly contacts the top edge of the second wall to thereby prevent rotation of the eighth wall inwards towards the base, by a ridge of the eighth wall directly contacting the top edge of the first wall.

13. A method comprising inserting a plurality of beverage containers into a chamber of an apparatus, the chamber formed by a first wall, a second wall, a base, a first device, and a second device;

wherein the apparatus is comprised of:

the first wall;

the second wall;

the base, wherein the first and the second walls are fixed to the base so that the first and the second walls are fixed substantially perpendicular to the base, such that the first and the second walls cannot rotate with respect to the base without breaking the apparatus, and the first and the second walls are parallel to each other and separated by a first distance;

the first device connected to the base so that the first device can rotate with respect to the base;

the second device connected to the base so that the first device can rotate with respect to the base;

wherein the first device includes a third wall, a fourth wall, and a fifth wall, wherein the third wall is fixed substantially perpendicular to the fourth and the fifth walls, and the fourth and the fifth walls are fixed to the third wall so that the fourth and the fifth walls are substantially parallel to each other and spaced apart by the third wall;

wherein the first device includes a sixth wall, a seventh wall, and an eighth wall, wherein the sixth wall is fixed substantially perpendicular to the seventh and the eighth walls, and the seventh and the eighth walls are fixed to the sixth wall, so that the seventh and eight walls are substantially parallel to each other and spaced apart by the sixth wall;

wherein the first device is connected to the base so that the first device can be rotated into a first state in which the third wall is substantially parallel to the base;

wherein the second device is connected to the base so that the second device can be rotated into a second state in which the sixth wall is substantially parallel to the base;

wherein the first device is connected to the base so that the first device can be rotated into a third state in which the third wall is substantially perpendicular to the base;

wherein the second device is connected to the base so that the second device can be rotated into a fourth state in which the sixth wall is substantially perpendicular to the base;

wherein the third wall of the first device has a width, and each of the fourth and the fifth walls have a width which is substantially perpendicular to the width of the third wall, and wherein the fourth and the fifth walls protrude out from the third wall in the direction of the width of the fourth and the fifth walls, respectively;

wherein the sixth wall of the second device has a width, and each of the seventh and the eighth walls have a width which is substantially perpendicular to the width of the sixth wall, and wherein the seventh and the eighth walls protrude out from the sixth wall in the direction of the width of the seventh and the eighth walls, respectively; and wherein the width of each of the seventh and the eighth walls is substantially less than the width of the sixth wall;

wherein in the third state in which the third wall is substantially perpendicular to the base, the fourth wall of the first device directly contacts a top edge of the first wall to thereby prevent rotation of the fourth wall inwards towards the base, wherein the top edge of the first wall is substantially parallel to the base, and the fifth wall of the first device simultaneously directly contacts a top edge of the second wall to thereby prevent rotation of the fifth wall inwards towards the base, wherein the top edge of the second wall is substantially parallel to the base;

wherein the prevention of the rotation of the fourth wall inwards towards the base together with the prevention of the rotation of the fifth wall inwards towards the base prevents rotation of the third wall inwards towards the base;

wherein in the fourth state in which the sixth wall is substantially perpendicular to the base, the seventh wall of the second device directly contacts the top edge of the first wall to thereby prevent rotation of the seventh wall inwards towards the base, and the eighth wall of the second device simultaneously directly contacts the top edge of the second wall to thereby prevent rotation of the eighth wall inwards towards the base; and wherein the prevention of the rotation of the seventh wall inwards towards the base together with the prevention of the rotation of the eighth wall inwards towards the base prevents rotation of the sixth wall inwards towards the base.

14. The method of claim 13 wherein the width of each of the fourth and the fifth walls is substantially less than the width of the third wall;

and wherein the width of each of the seventh and the eighth walls is substantially less than the width of the sixth wall.

15. The method of claim 14 wherein the first wall has a height which is a perpendicular distance from the base to the top edge of the first wall;

the second wall has a height which is a perpendicular distance from the base to the top edge of the second wall;

and wherein the heights of the first wall and the second wall are about the same and are about equal to the width of the fourth, fifth, seventh, and eighth walls.

16. The method of claim 14 wherein the first wall was a first indentation and a second indentation;

the second wall has a first indentation and a second indentation;

the fourth wall has a protrusion;

the fifth wall has a protrusion;

the seventh wall has a protrusion;

the eighth wall has a protrusion;

and wherein the protrusions of the fourth and fifth walls fit into the first indentation of the first wall, and the first indentation of the second wall, respectively, when the first device is in the third state; and and wherein the protrusions of the seventh and eighth walls fit into the second indentation of the first wall, and the second indentation of the second wall, respectively, when the second device is in the fourth state.

17. The method of claim 13 wherein the apparatus is further comprised of:

a first member fixed perpendicular to the first wall at a first end of the first wall, the first member having a bore;

a second member fixed perpendicular to the second wall at a first end of the second wall, the second member having a bore;

a third member fixed perpendicular to the first wall at a second end of the first wall opposite the first end of the first wall, the third member having a bore;

a fourth member fixed perpendicular to the second wall at a second end of the first wall opposite the first end of the first wall, the second member having a bore;

a fifth member fixed to the first device having a bore;

a sixth member fixed to the second device having a bore;

a first axle inserted into the bores of the first member, the second member, and the fifth member to rotatably connect the first device to the base; and a second axle inserted into the bores of the third member, the fourth member, and the sixth member to rotatably connect the second device to the base.

18. The method of claim 13 wherein the first device includes a first U-shaped ridge, which protrudes out from a combination of the third wall, the fourth wall, and the fifth wall; and the second device includes a second U-shaped ridge which protrudes out from a combination of the sixth wall, the seventh wall, and the eighth wall.

19. The method of claim 18 wherein the first device includes a third U-shaped ridge, spaced apart from and parallel to the first U-shaped ridge, which protrudes out from a combination of the third wall, the fourth wall, and the fifth wall; and the second device includes a fourth U-shaped ridge, spaced apart from and parallel to the second U-shaped ridge, which protrudes out from a combination of the sixth wall, the seventh wall, and the eighth wall.

20. The method of claim 19 wherein the first device includes a fifth U-shaped ridge, spaced apart from and parallel to the first and the third U-shaped ridges, which protrudes out from a combination of the third wall, the fourth wall, and the fifth wall; and the second device includes a sixth U-shaped ridge, spaced apart from and parallel to the second and the fourth U-shaped ridges, which protrudes out from a combination of the sixth wall, the seventh wall, and the eighth wall.

21. The method of claim 13 wherein when the first device is in the third state and the second device is simultaneously in the fourth state, there is a first gap between the first device and the second device adjacent the first wall and a second gap between the first device and the second device adjacent the second wall;

wherein when the first device is in the third state and the second device is simultaneously in the fourth state the apparatus has a height and a length;

wherein the first gap has a height which is greater than one half of the height of the apparatus and a length which is greater than one half of the length of the apparatus; and wherein the second gap has a height which is greater than one half of the height of the apparatus and a length which is greater than one half of the length of the apparatus.

22. The method of claim 13 wherein the base has a first plurality of openings;

the third wall has a second plurality of openings;

and the sixth wall has a third plurality of openings.

23. The method of claim 19 further comprising wrapping a wrapping material around a periphery of the apparatus between the first U-shaped ridge and the third U-shaped ridge and between the second U-shaped ridge and the fourth U-shaped ridge to thereby prevent the third wall from rotating away from the base and the sixth wall from rotating away from the base.

* * * * *